US008661945B1

(12) United States Patent
ElDessouky

(10) Patent No.: US 8,661,945 B1
(45) Date of Patent: Mar. 4, 2014

(54) CLAMPING RATCHET WRENCH

(76) Inventor: Ali W ElDessouky, Rochester Hills, MI (US)

( * ) Notice: Subject to any disclaimer, the term of this patent is extended or adjusted under 35 U.S.C. 154(b) by 0 days.

(21) Appl. No.: 13/114,973

(22) Filed: May 24, 2011

Related U.S. Application Data

(60) Provisional application No. 61/347,636, filed on May 24, 2010.

(51) Int. Cl.
*B25B 13/00* (2006.01)

(52) U.S. Cl.
USPC ..... 81/58.2; 81/63.2; 81/61

(58) Field of Classification Search
USPC ..... 81/58.2, 58.4, 61, 63.1, 63.2, 58.5
See application file for complete search history.

(56) References Cited

U.S. PATENT DOCUMENTS

| | | | | | |
|---|---|---|---|---|---|
| 1,412,688 | A | * | 4/1922 | Layton et al. | 192/45.006 |
| 2,712,256 | A | | 7/1955 | Fish | |
| 2,758,493 | A | | 8/1956 | Goldwater | |
| 3,175,434 | A | | 3/1965 | Bergquist | |
| 3,906,822 | A | * | 9/1975 | Hertelendy et al. | 81/90.1 |
| 3,927,582 | A | | 12/1975 | Hertelendy et al. | |
| 4,095,494 | A | * | 6/1978 | Castoe | 81/63.2 |
| 4,258,595 | A | | 3/1981 | Ramsey | |
| 4,318,315 | A | | 3/1982 | Washburn | |
| 4,327,610 | A | | 5/1982 | Chiarenza | |
| 4,562,757 | A | | 1/1986 | Furey | |
| 5,467,672 | A | * | 11/1995 | Ashby | 81/58.2 |
| 5,535,647 | A | * | 7/1996 | Donaldson, Jr. | 81/59.1 |
| 5,845,549 | A | * | 12/1998 | Bouligny | 81/57.33 |
| 6,155,140 | A | * | 12/2000 | Tsai | 81/61 |
| 7,188,550 | B2 | * | 3/2007 | Tsai | 81/58.2 |
| 7,249,539 | B2 | * | 7/2007 | Decaprio | 81/58.2 |
| 8,100,036 | B2 | * | 1/2012 | Huang | 81/58.2 |
| 8,186,246 | B2 | * | 5/2012 | Niven | 81/57.16 |
| 2009/0151518 | A1 | * | 6/2009 | Abunameh | 81/58.2 |

* cited by examiner

*Primary Examiner* — Lee D Wilson
*Assistant Examiner* — Melanie Alexander
(74) *Attorney, Agent, or Firm* — Cargill & Associates, PLLC; Lynn E. Cargill

(57) ABSTRACT

A clamping ratcheting wrench is disclosed that is capable of being opened and closed without slipping the wrench over the end of a nut to be tightened or loosened. This wrench overcomes many problems because it may be used on a nut that is in a very tight position where a traditional wrench would not fit, nor would a conventional wrench be capable of ratcheting. The ratchet is effected by individual ratchet segments that are held in place when the wrench is opened. One of the true advantages of the various aspects is that the ratchet can be opened and closed once the ratchet segments are aligned, such that the segments are secured in place to allow the wrench to be opened up without having all the segments fall out of the wrench. A first aspect of the invention discloses an interlocking ratchet piece design, while a second aspect of the invention discloses another ratchet piece design with structural channeling to secure the ratchet segments in alignment so that the segments do not come out of the wrench.

14 Claims, 14 Drawing Sheets

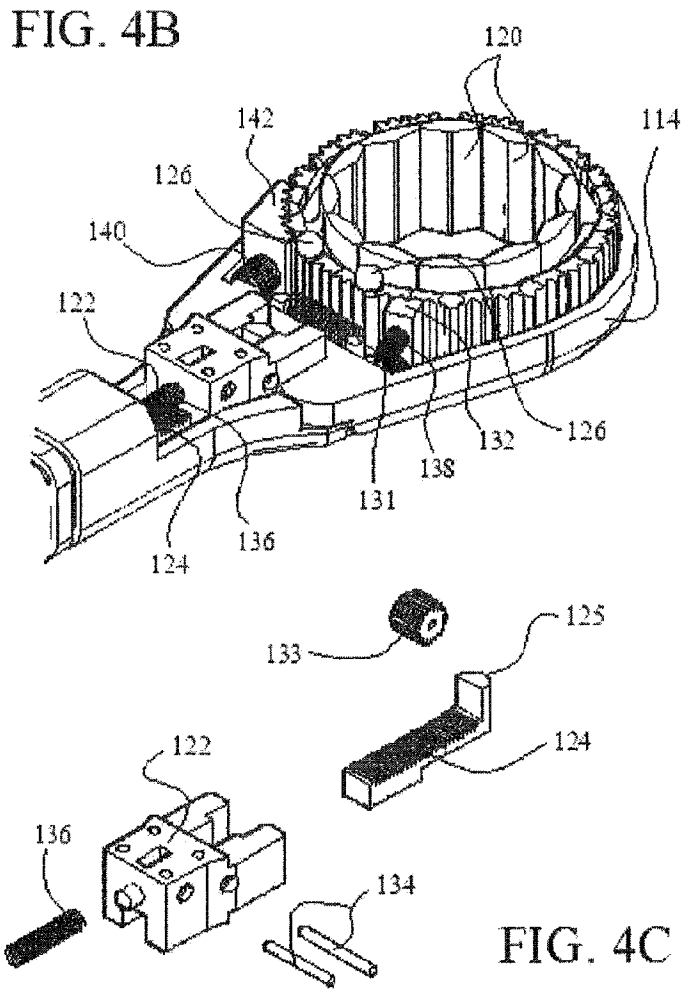
FIG. 4B
FIG. 4C
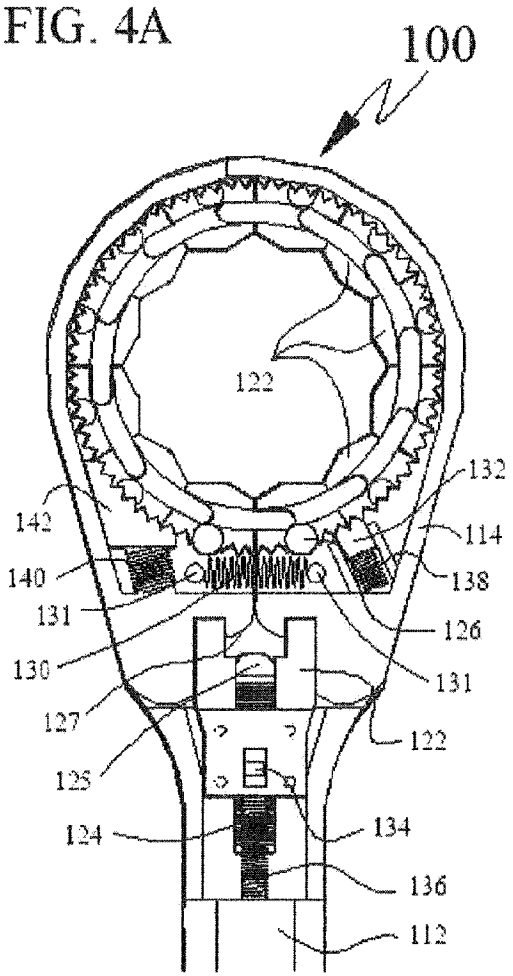
FIG. 4A

CLAMPING RATCHET WRENCH

CROSS-REFERENCE TO RELATED APPLICATIONS

This application claims the benefit under 35 U.S.C. 119(e) of U.S. Provisional Application No. 61/347,636 filed on 24 May 2010.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED, INCLUDING ON A COMPACT DISC

Not Applicable

TECHNICAL FIELD

This invention relates to an open ended ratchet wrench, and more particularly relates to a clampable open ended ratchet wrench.

BACKGROUND OF THE INVENTION

There has been a long felt need for a clampable open ended ratchet wrench that can be opened and closed to tighten a nut in a situation where the conventional closed end ratchet wrench cannot be slipped down onto the nut to be tightened or released, such as in the middle of a pipe, where access to the nut is quite limited. Inserting a wrench around a nut that is midway located in a pipe or other fitting, sometimes occurring under a sink, or within a kitchen cabinet, has plagued many a plumber. Needless to say, there are many other circumstances where the tight quarters could advantageously employ a new type of clamping ratchet wrench. In certain circumstances, it is nearly impossible to utilize a classic crescent wrench, because there is not enough space to move the lever and the wrench handle to provide quick and effective wrenching action.

Traditionally, a long pipe with a nut in the middle that required tightening was tightened with an open end crescent wrench. This job is slow and tedious. For obvious reasons, a ratchet wrench would be preferable for this task, although heretofore, there has not been a clampable open ended ratchet wrench that was available that could apply full pressure all the way around the nut. In trying to solve this problem by coming up with a solution, prior art attempts have yielded various configurations with a ratchet on a separate piece that twirls or swings around the nut to be tightened or loosened, but this also requires a certain amount of space that may not be available to the user.

U.S. Pat. No. 4,327,610, issued to Angelo Chiarenza on May 4, 1982, discloses an open end wrench that includes a slot to receive a nut, along with spring segments that project inwardly to act as the ratcheting device. The ends of the segments turn on the flat surfaces of the nut when the wrench is turned in the tightening direction. In order to effect a ratchet action, the cantilever springs flex to skim over the corners of the nut and then spring back to apply pressure to the flat surfaces of the nut. However, the open ended wrench does not completely surround the nut to provide full and complete engagement of all surfaces to provide maximum torque.

Another invention attempting to solve this problem of allowing for a ratchet wrench in a limited access mid-pipe nut tightening situation is embodied in various promotions, including the use of split socket wrenches that include swinging arm members so that the wrench can be opened. The swinging arm member can then pivot out and around the nut and is clamped back on top of itself toward the handle before the ratcheting action is made possible. This swinging member is not automatically put into place, but rather requires a bit of work on the part of the operator. Further, it may require enough of a clearance behind the pipe with the nut in the middle, so as to prevent the swinging arm from swinging into proper position. In that regard, U.S. Pat. No. 4,562,757, issued to James Furey on Jan. 7, 1986, discloses such a split socket wrench including a swinging arm member for enclosing the nut. This device would be impossible to use under many conditions. A better design is needed for a clamping ratcheting open end wrench.

Therefore, there has been a long felt need for a clamping ratchet wrench that automatically opens and closes around a nut so that the ratcheting operation can be maneuvered in limited access spaces. An automatic wrench would be most advantageous, and the industry would welcome such an invention. In that regard, the industry is now ready for a clamping ratchet wrench which can be effectively utilized in very close quarters. Especially useful would be a ratcheting wrench which can be opened and closed when pressed up against a nut.

SUMMARY OF THE INVENTION

In accordance with the above-noted desires of the industry, the present invention provides various aspects, including a clampable ratcheting wrench that is capable of being opened and closed without slipping the wrench over the end of a nut to be tightened or loosened. Also disclosed is a method of making same, and a method of using the wrench. This wrench overcomes many of the aforementioned problems with the prior art because the present invention may be used on a nut that is in a very tight position where a traditional wrench would not fit, nor would a conventional wrench be capable of ratcheting.

The ratchet is effected by individual ratchet segments that are held in place when the wrench is opened. One of the true advantages of the various aspects is that the ratchet can be opened and closed once the ratchet segments are aligned, such that the segments are secured in place to allow the wrench to be opened up without having all the segments fall out of the wrench.

A first aspect of the present invention includes certain features including a ratcheting portion which can be opened to go around a nut to be tightened rather than slipping the ratchet over the nut. Prior open end ratchet wrenches utilized a swing-around arm to effect a fully closed ratchet, although there are many instances where there just is not enough room to accommodate a swing-around arm. The present invention overcomes that problem by opening in the wrench itself to provide a very tight clearance, such that the wrench can be used in impossibly tight quarters. Once opened, the ratchet segments stay in place after alignment, so that the segments do not fall out.

The first aspect of the invention discloses an interlocking ratchet piece design, while a second aspect of the invention discloses another ratchet piece design with structural channeling to secure the ratchet segments in alignment so that the segments do not come out of the wrench.

The second aspect of the present invention discloses another ratchet segment design which differs from the design of the first aspect because rather than the segments interlocking with each other, the segments are carried on a channel formed into the upper and lower clamp housings. Once aligned, and the segment pieces are secured, then the wrench can be opened.

BRIEF DESCRIPTION OF THE DRAWINGS

For a further understanding of the nature and advantages of the expected scope and various aspects of the present invention, reference shall be made to the following detailed description, and when taken in conjunction with the accompanying drawings, in which like parts are given the same reference numerals, and wherein:

FIG. 4A is a cross sectional view of the inner workings of the first aspect of the invention;

FIG. 4B is a perspective view of the inner workings of the first aspect of the invention;

FIG. 4C is an exploded view of a portion of the invention;

Although the invention will be described by way of examples hereinbelow for specific aspects having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different aspects and its details are capable of modifications of various aspects which will be obvious to those of ordinary skill in the art all without departing from the spirit of the present invention. Accordingly, the rest of the description will be regarded as illustrative rather than restrictive.

DETAILED DESCRIPTION OF THE INVENTION

The present clamping ratchet wrench invention disclosure includes various aspects of the invention, each including a series of individual ratchet key segments that can remain in the wrench while it is being opened and closed in synchronicity in an automatic fashion. Such aspects help to provide a wrench that can be clamped around a pipe with a nut surrounding the pipe, and then ratcheted to tighten or loosen the nut. The present invention also discloses a clamp ratchet wrench that includes a finger operable retractable handle that when retracted, the clamp automatically opens due to a spring action, and can be pressed directly against the nut of a pipe that needs to be tightened. When the clamp ratchet wrench of the present invention is pressed against the nut and the finger operable retractable closing device is pushed toward the pipe, the interlocking key mechanisms are automatically aligned and the clamp wrench portion automatically closes around the nut.

This very clever device utilizes an entirely new form of ratcheting key mechanisms, although it utilizes a pawl as is common in normal ratcheting devices. The various aspects of the invention disclose ratchet key designs which are new, and not shown before in other wrench configurations. This new and novel wrench design will be described more fully herein below with reference to FIGS. 1-19, detailing the mechanisms.

Figure 1:
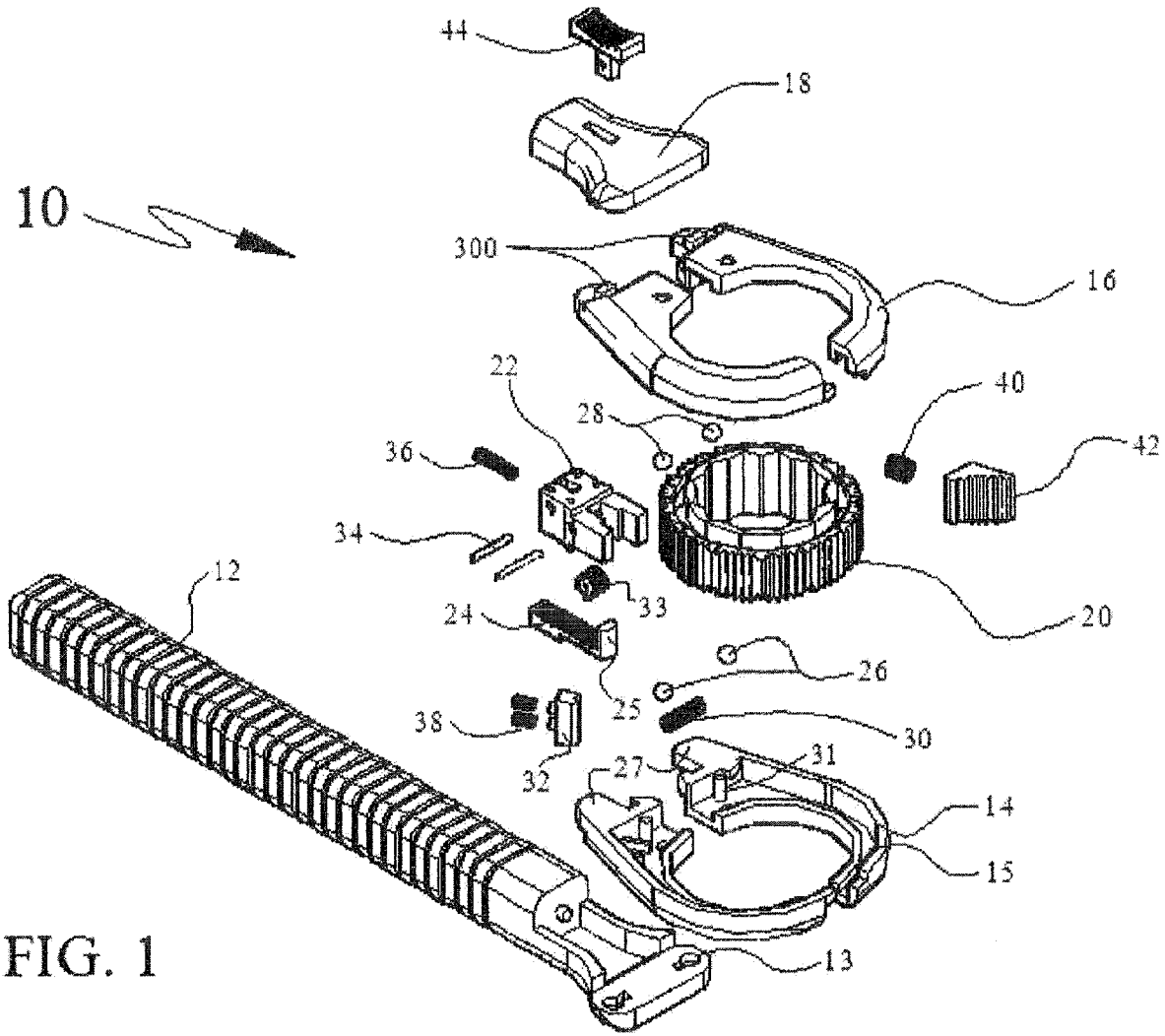
FIG. 1 is an exploded perspective view of a first aspect of a clampable ratchet wrench made in accordance with the present invention.

Looking first to FIG. 1, there is shown an exploded perspective view of the clamp ratchet wrench of the present invention, generally denoted by the numeral 10. The wrench includes a handle 12 which receives a lower clamp housing 14 on its distal end. Within the proximal end of the ratchet wrench handle 12, there is a clamp lock and pivot aperture 13 which allows the lower clamp housing 14 to rotate and pivot to open and close around the nut. An upper clamp housing 16 includes an indented portion which forms a race 15 to receive ratchet keys 20. Upper and lower clamp housings 14 and 16 are operated by the use of a retractable latch button 44 that works in conjunction with a lock 22. Underneath lock 22 is a separation lever 24 that includes a rounded head 25, one of the clever innovations of the present invention. The function of the rounded head for automatically aligning certain components will be discussed more fully herein below with reference to FIGS. 4A and 4B.

Still referring to FIG. 1, a set of lower and upper alignment balls 26 and 28, respectively, are carried in indentations on the inside of both the upper and lower clamp housing 14 and 16, respectively. As the ratchet keys 20 rotate, the upper and lower alignment balls 26 and 28, respectively, fall in the indentations located on the top and bottom of each ratchet key 20 indicating that the ratcheting keys 20 are aligned allowing the wrench to open if the operator retracts the retractable latch button 44. Hips 27 included in the design of the lower and upper clamp housings are in operable communication with the rounded head 25 of separation lever 24. Although they may be any suitable configuration, dogs 300 are semi-rectangular posts extending into an aperture within hips 27. Dogs 300 can help to open up the clampable ratchet wrench of the present invention, and are more fully described hereinbelow with reference to FIG. 9.

Clamp spring 30 attaches to a clamp spring post 31 and acts to retract the clamping the upper and lower clamp housings to bring the wrench automatically back into place. Ratchet key lock 32 will become operably engaged with gear teeth on the back of ratchet keys 20 during operation. Ratchet lock springs 38 put the ratchet key lock 32 into position in order to prevent ratchet keys 20 from sliding out of upper and lower clamp housing 6 and 14, respectively, when separation lever track gear 33 moves upwardly and urges separation lever 24 into operation. Button lock-in pins 34 hold the track gear 33 and the retractable latch button 44 in place, such that track gear 33 is used to urge separation lever 24 forward or backward to engage or disengage the housings into position around the nut. Lock spring 36 is attached to the back of lock 22 to automatically push lock 22 forward consequently locking upper housing clamp 16 and lower housing clamp 14.

The ratcheting keys 20 have gear faces on their backside. These gear faces have been engineered to mate against the surface of a pawl 42 which is kept in place by pawl spring 40. A retractable latch button 44 is used by the operator with a thumb action to push the lock on the track gear backward and forward to press the upper and lower housings into their clamped and unclamped positions.

Figures 2A, 2B:
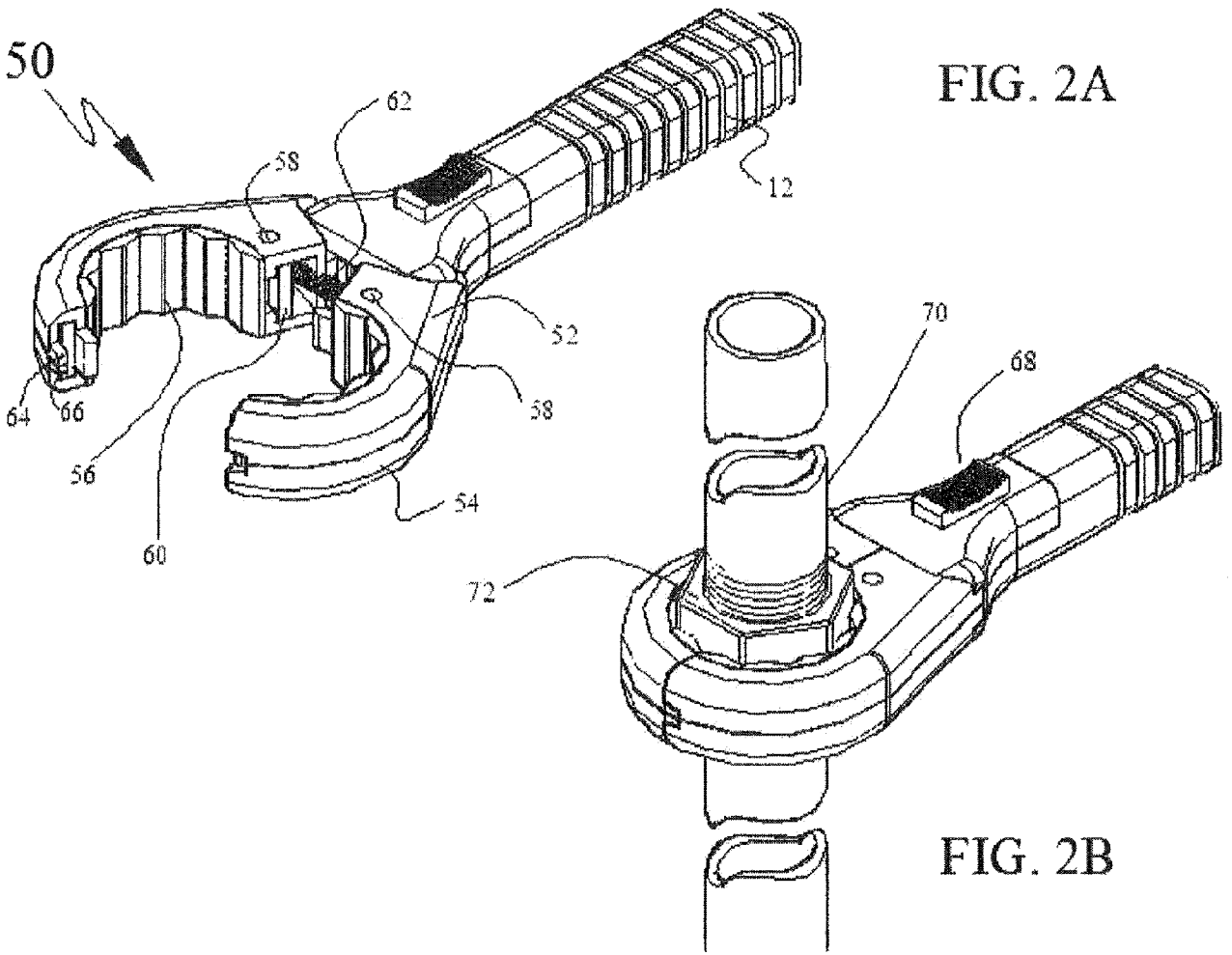
FIG. 2A is a perspective view of the wrench with the open end in the open position.
FIG. 2B is an environmental perspective view of the wrench being used to tighten a nut.

Looking next, with combined reference to FIGS. 2A and 2B, there is seen another perspective view of the clamp ratchet wrench generally denoted by numeral 50 including upper and lower clamp housings 52 and 54, respectively. The individual ratchet keys 56 are shown as indicating proper placement by alignment balls 58. From the side, the key push face 60 can be seen in this Figure and the mechanism is operated when the operator rotates the wrench while clamped around nut. At the distal opening of the clamping housing, there are upper and lower clamp alignment guides 64 and 66, respectively, which are received in the other side of the clamping housing. The retractable latch button 68 is positioned by the thumb of the operator, thereby opening and closing the clamping mechanism 50 around nut 72 fastened to a pipe 70. The interim stages of the utilization of the present invention are now to be disclosed with regards to FIGS. 3A to 3C.

Figure 3C:
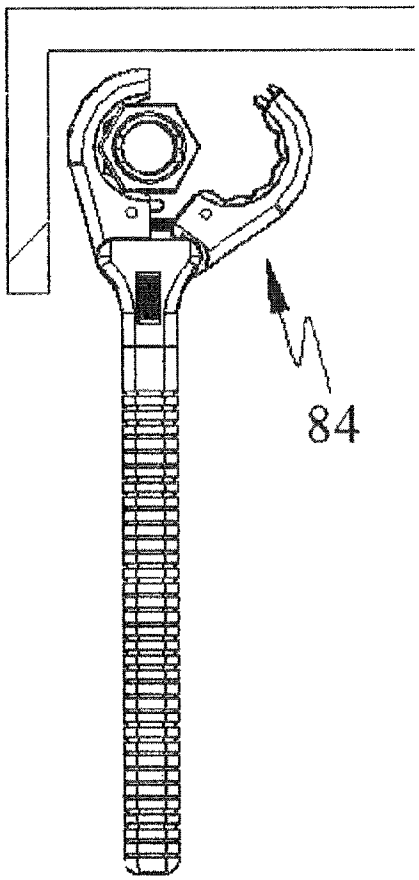
FIG. 3C is a top plan view of the wrench in a semi-closed position.
Figure 3B:
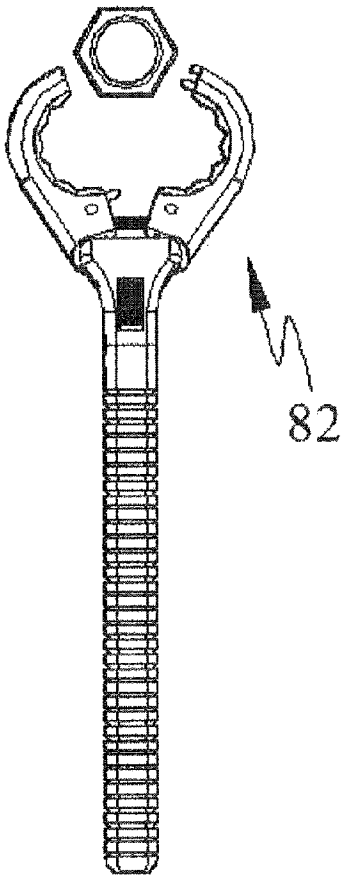
FIG. 3B is a top plan view of the wrench in an open position.
Figure 3A:
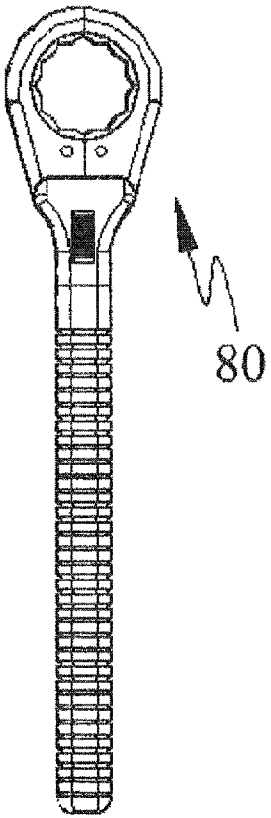
FIG. 3A is a top plan view of the wrench in a closed position.

With combined reference now to FIGS. 3A through 3C, there can be seen the various mechanisms by which the present invention can be utilized. The entirely closed clamping mechanism is generally denoted by numeral 80, in FIG. 3A, while the entirely open mechanism is denoted by numeral 82 as shown in FIG. 3B. As one can see from this drawing, the wrench approaches the nut in an open position, and then the latch button shown on top can be utilized to clamp the wrench around the nut into the closed position. FIG. 3C illustrates the partially opened configuration 84, where the pipe is too close to the corner of a limited access area. In this situation, only one half of the clamping mechanism can be opened up. However, utilizing the latch button, it can still be closed and then ratcheted to tighten.

Referring next to FIG. 4A through 4C, FIG. 4A is a top planned view of the interworking, and is generally denoted by numeral 100 and includes handle 112 onto which clamp housing 114 is rotatably engaged. The individual ratchet keys 120 can be seen in their closed position. The lock 122 sits on top of, and is engaged with, separation lever 124 having a rounded head 125. The alignment balls 126 are shown in position on of ratchet keys 120 that are on top of horizontal lock housing 127. Clamp spring 130 is secured by posts 131, while the ratchet key lock 132 that engages the rear geared portion of ratchet keys 120 is urged into position by ratchet lock spring 138.

Now let us look at how the mechanism works. As lock 122 rides up and down on separation lever 124 on its track, the rounded head 125 is pushed upwardly against hip 127 which pushes the housing 114 apart. The lock spring 136 retracts the lock 122 after operation.

To more carefully see how the alignment balls work, FIG. 4B is a front perspective elevational view where the alignment balls 126 sit in the indentations in the top of ratchet keys 120. Pawl 142 is held in engagement with the ratchet keys by pawl spring 140 when lock 122 is urged forward by the lock spring 136.

FIG. 4C illustrates the interworkings of the lock mechanism which includes the lock itself 122 which is kept in place by lock spring 136. Within the contours of lock 122 is a track (not shown in this figure) for receiving the geared upper portion of the separation lever 124. Track gear 133 rolls against the upper geared portion of separation lever 124 and is held in place by button lock-in pins 134.

Figure 5:
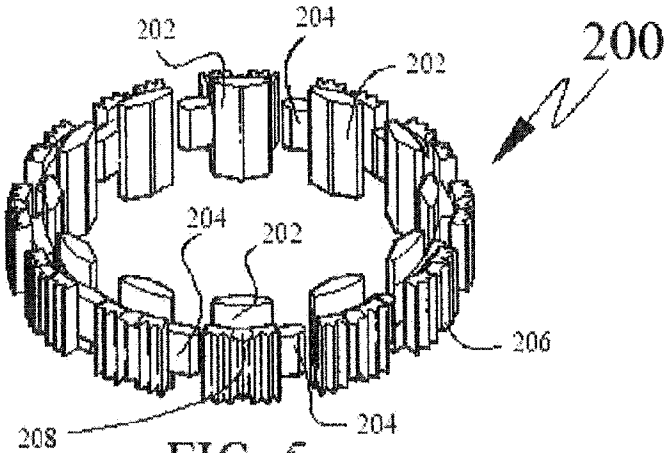
FIG. 5 is an exploded view of the ratchet pieces illustrating the interlocking feature of the first aspect of the invention.

Looking next to FIG. 5, the individual ratchet keys, here generally denoted by the numeral 200, include individual interlocking keys that roll in a race of the clamping housings shown in the other Figures. Each of the ratchet keys include a segment face 202 for receiving the flat surfaces of the nut being tightened, and also include a ratchet key blade 204 that separatably interlocks the various ratchet segments 202 to form the overall ratchet key 200. On the backside of the individual ratchet segments 202 is a geared portion pawl catch 206 for engagement with the pawl. On top of the ratchet segments, there are alignment ball indentation receivers 208, useful for aligning the various components in an automatic fashion. Ratchet key blades 204 are received within an indentation, shown most clearly in FIG. 8, described below.

Figure 6:
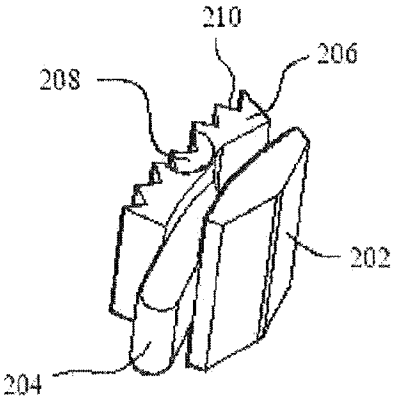
FIG. 6 is a top perspective view of a single ratchet segment.

FIG. 6 is a close up perspective view of an individual ratchet segment 202 clearly showing the relative placement of the ratchet key blade 204, the pawl catch 206, the alignment ball indentation receiver 208, and the pawl catch faces 210 formed in the outer surface.

Figure 7:
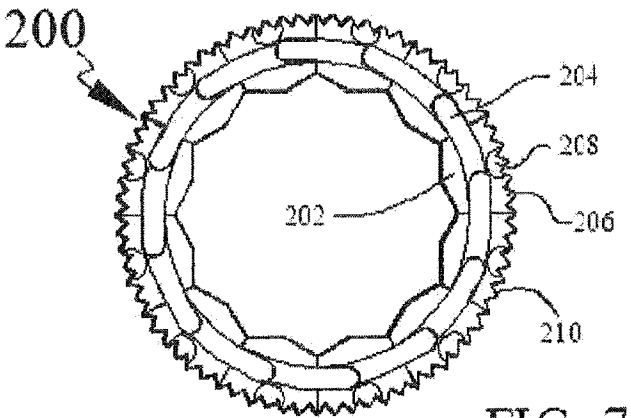
FIG. 7 is a top plan view of the interlocking ratchet segments of FIG. 5 when interlocked.

FIG. 7 shows the interconnectivity of all the ratchet segments when they are in a closed position, and show how the ratchet segments abut one another when they are in the closed position.

Figure 8:
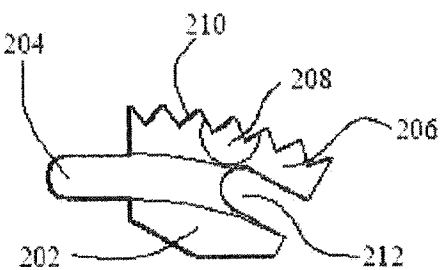
FIG. 8 is a top plan view of a single ratchet segment.

FIG. 8 is a top plan view of ratchet segment 202 clearly showing the ratchet key blade 204, pawl catch 202 having pawl catch faces 210 formed in their backside, and alignment ball indentation receiver 208. Ratchet key receiver aperture 212 is sized and adapted for receiving the ratchet key blade 204.

Figure 9:
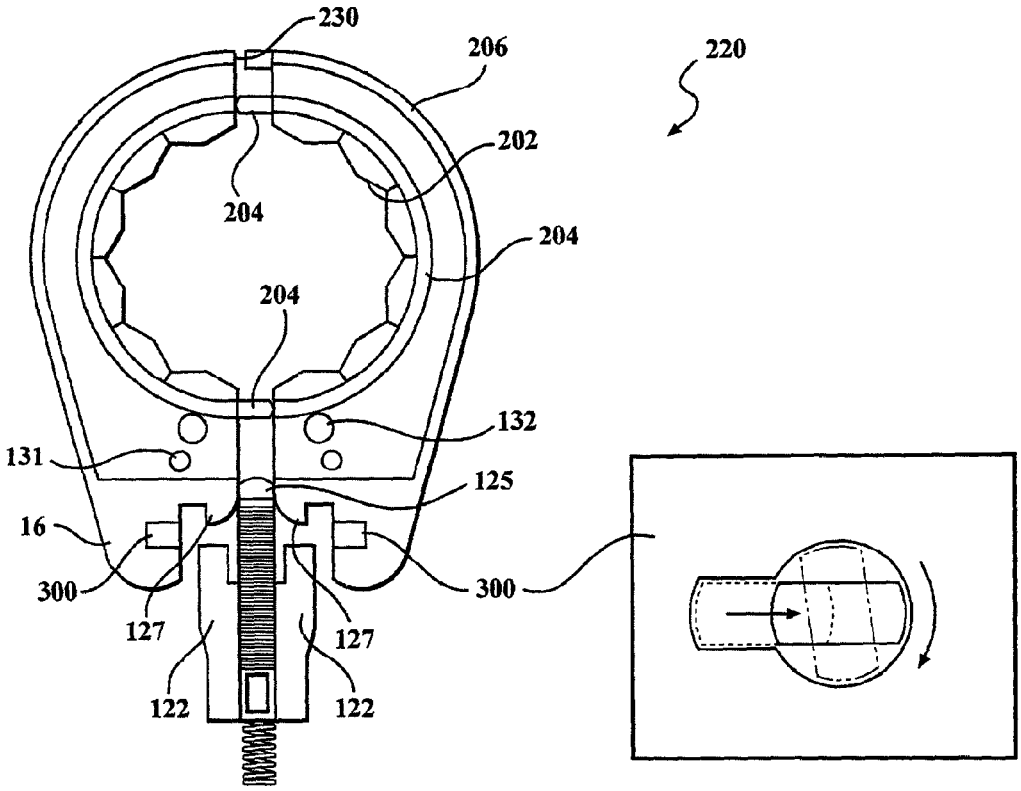
FIG. 9 is a top plan view of the wrench in a nearly closed position, with a close up window of the twisting mechanism.

FIG. 9 is a top plan view of the working distal end of the clamp ratchet wrench of the present invention. This working end is generally denoted by numeral 220 and show the front faces 202 with an exposed interlocking keyblade 204 disengaged from its adjacent key. Clamp housing 16 provides the structure for opening and closing the wrench. As the clamp wrench is opened by the rounded head 125 being urged upward to force spreader hips 127 apart, dogs 300 are semi-rectangular posts extending into an aperture shown in the close-up shadow in this FIG. 9. The lock 122 sits on top of, and is engaged with, separation lever 124 having a rounded head 125.

FIG. 9 is accompanied by a close up vignette illustration showing the relative placement of dogs 300 as they extend into the slot and then are forced outwardly into the round aperture, thereby permitting full rotation. Once dog posts 300 are rotated within the rounded aperture, the housing is forced apart, thereby disengaging keyblades 204 at the outer most circumference and at the innermost circumference. Once the keyblades clear their engagement point from behind face section 202, the clamp ratchet wrench can be opened up as shown more clearly with respect to FIGS. 3A-3C.

The aspect of the invention described above discloses the interlocking ratchet key designs which enable this clamp ratchet wrench to open at nearly any location around the clamp housings shown in the Figures above. It is this interlocking ratchet key, in combination with the hip opening action of the rounded head in the lock track gear mechanism, which renders this invention new and non-obvious over prior art attempts at solving the same problem. In addition, the utilization of the alignment balls keep each of the interlocking ratchet segments in proper position when the clamp is open and ready for action. Various springs help to keep the ratcheting action going are utilized, with a clamp spring secured by posts 131.

Figure 10:
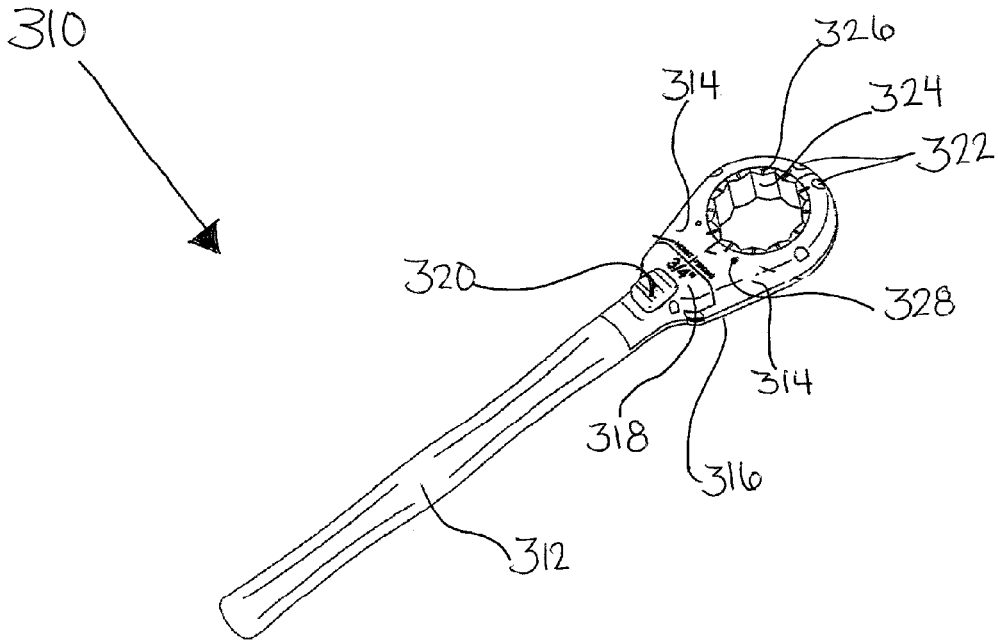
FIG. 10 is a perspective view of a second aspect of the present invention.

FIG. 10 is a perspective view of yet another aspect of the present invention, with a second design for the ratchet segments engagement and disengagement. This second aspect is generally referred to by the numeral 310, and includes a handle 312 with a ratchet upper clamp housing 314 secured on top of a ratchet lower clamp housing 316 at the distal end of the handle. Clamp cover 318 houses the underlying mechanism, detailed more fully hereinbelow with reference to further drawings. Retractable latch button 320 is operable by the user to open and close the clampable ratchet wrench. Clamp housing fasteners 322 secure the upper and lower clamp housings 314 and 316, respectively. Individual ratchet segments 324 are shown. Alignment guides 326 are located on the top of the ratchet segments 324, and they are used to keep the individual segments 324 aligned for proper usage. Alignment pins 328 extend slightly above the upper surface of the upper clamp housing 314, so that the user can feel when the pins 328 are extended. When the pins 328 extend upwardly enough for the user to feel them, then the user knows that the ratchet segments 324 are in alignment such that the wrench 310 can be opened.

Figure 11:
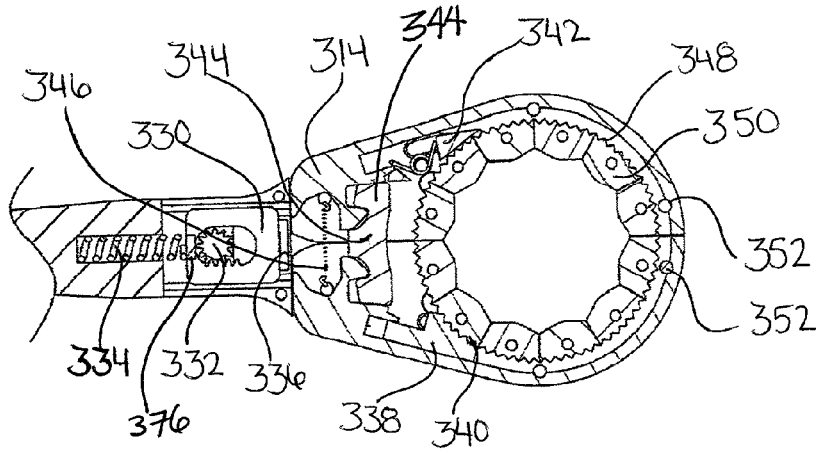
FIG. 11 is a bottom cross-sectional view of the wrench, showing the relative placement of the lock and the lock spring constructed in accordance with the present invention.

FIG. 11 illustrates how the release slide 330 moves the release gear 332 against lock spring 334. Clamp spring 346 holds upper clamp housing 314. Ratchet teeth 348 of ratchet segments 350. Ratchet teeth 348 engage pawl teeth 340 on the face of the pawl 338. Fasteners 352 hold together the upper clamp housing 314 from lower clamp housing 316 (not shown in this view). Lock pawl 342 is diametrically opposed to pawl 338, and is pushed into position by lock 344. Hence, when the release slide 330 is pulled backward, the release gear 332 pushes lock 344 forward to open the ratchet as more fully shown in reference to FIG. 12 below. Lock spring 334 urges the release slide 330 to maintain in a closed position unless forced open.

Figure 11A:
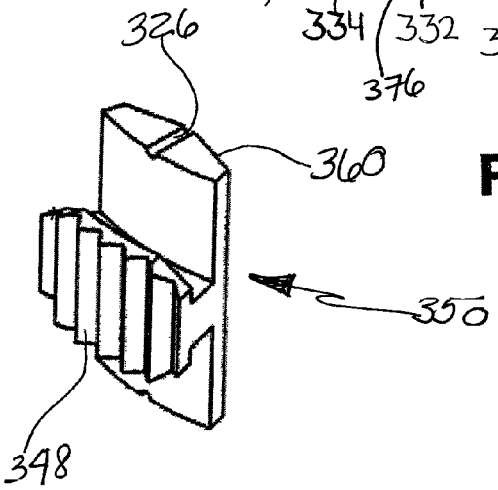
FIG. 11A is a rear perspective view of an individual ratchet segment.

Referring now to FIG. 11A, ratchet segment 350 is shown with ratchet teeth 348 extending from the middle portion, with a reduced dimension channel between it and the ratchet segment face piece 360. The channel that is created rides in a channel that is formed by the upper and lower clamp housings, 314 and 316 respectively, so that the segment pieces do not fall out of the housings when the wrench is opened up. Alignment guide 326 helps to put all of the segments in alignment so that when the wrench is opened, the pieces do not fall out because, once aligned, locking pins hold in the segment pieces as described more fully hereinbelow.

Figure 11B:
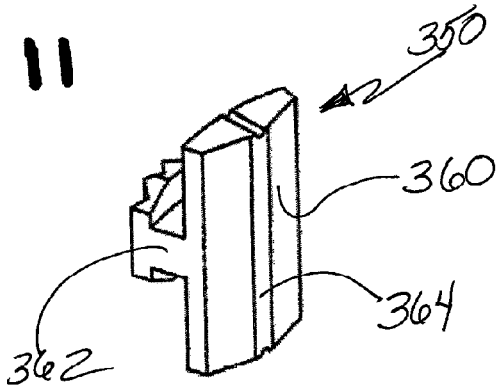
FIG. 11B is a front perspective view of the ratchet segment of FIG. 11A.

Looking next to FIG. 11B, the opposite side of ratchet segment 350 is shown including the face 360 of the ratchet segment. The channel riding portion 362 will be contained within the grooves created by the two housings coming together. The segment face 360 will act as the pressure point against the nut that is desired to be tightened or loosened. The flattened groove 364 on part of the face 360 helps in the alignment and locking procedure.

Figure 11C:
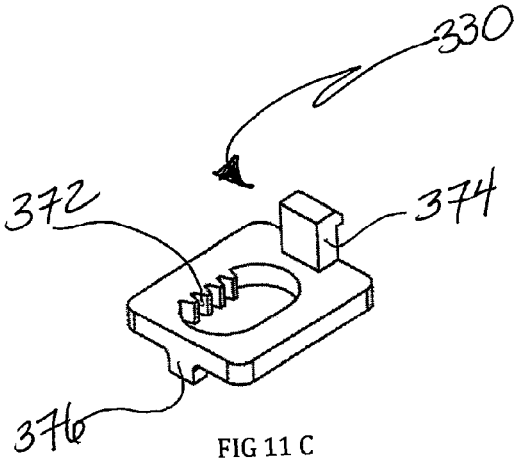
FIG. 11C is a perspective view of a release slide.
Figure 11D:
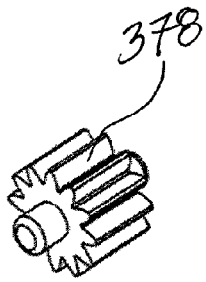
FIG. 11D is a perspective view of a gear used with the retractable slide.

Looking next to FIG. 11C, release slide 330 shows the relative placement of the slide gear teeth 372 that ride on gear 378 shown in FIG. 11D. Slide gear teeth 372 mate with the ratchet gear teeth 378 and work to move the lock 344 into position. Button clip 374 engages the release slide 330 to the retractable slide button on the face of the tool itself, while the lock spring support 376 acts as a resting place for lock spring 334 as shown in FIG. 11. Lock spring support 376 urges spring 334 back to its recoiled position in operation.

Figure 12:
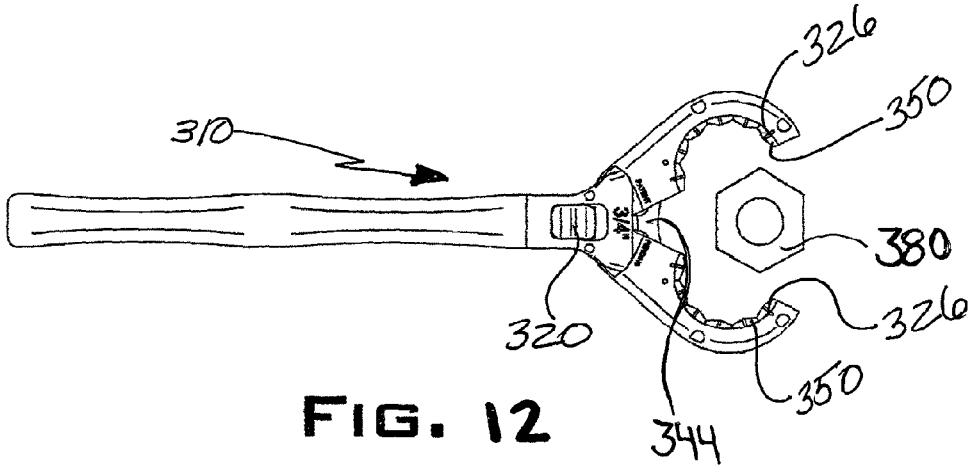
FIG. 12 is a top plan view of the second aspect of the present invention in an open position.

Referring next to FIG. 12, wrench 310 is shown in an open position with the lock 344 urged forward by pulling back on the retractable button 320. Note that when the operator pulls back on the retractable button 320, lock 344 is urged forward through the clamping portion of the wrench in the opposite direction from the handle. By pulling back on button 320, the gear mechanism of the release slide 330 of FIG. 11C is pushed in the opposite direction, so that lock 344 is urged forward when release button 320 is pulled back. When an operator wants to open the clamping wrench to surround a nut 380, the clamp is opened. As one can see from FIG. 12, the ratchet segments 350 stay in place because the alignment guides 326 have become aligned with the lock pin arrangement, more carefully shown with regards to FIGS. 17A and 17B. For now, it suffices to know that once the alignment guides 326 are in position, the locks can be effected, locking in the ratchet segments 350 so that they do not come out. Once the wrench is in proper position around nut 380, the wrench is closed and the ratcheting action can begin.

Figure 13:
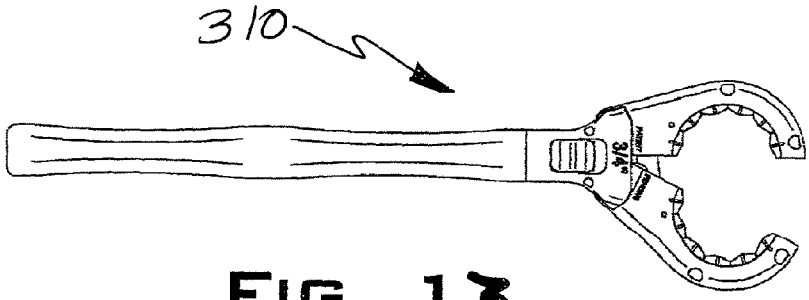
FIG. 13 is a top plan view of the second aspect of the present invention in an semi-open position.

FIG. 13 shows how the clamping wrench can have only one half of the clamping device open at a time, which may be very useful in extremely tight situations where the ratcheting portion needed to fit around a nut has a physical hindrance in very close proximity, necessitating the use of a half open ratchet wrench.

Figure 14:
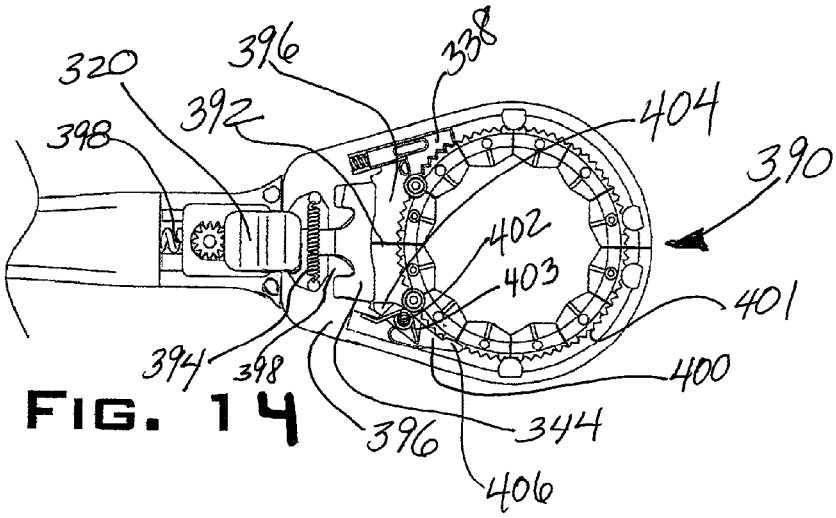
FIG. 14 is a top plan view of the wrench with the upper clamp housing removed to show the inner workings.

FIG. 14 shows the clampable ratchet wrench locked in a retracted position. When the operator pulls back on the retractable button 320, this drives the lock forward, thereby releasing lock key 398 so that the wrench can pivot forward and allow the wrench to open at the breaking points 390 and 392. Clamp spring 394 helps to hold together clamp housing 396 as all components are urged forward by lock spring 398 holding the lock in place. Lock 344 pushes against clamp housing 396 and holds the ratchets in place.

Figure 14A:
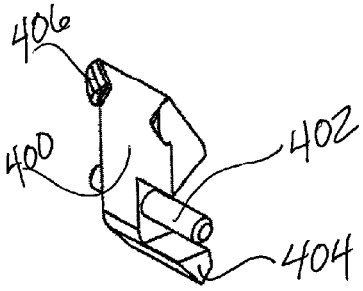
FIG. 14A is a perspective view of a lock pawl front elevation.

As there are many pieces to be considered here, we are separately taking FIG. 14A to show the front view of the lock pawl 400. The spring receiver 402 also acts as the axis for pivoting described above with reference to FIG. 14. Lock pawl 400 has a pawl catch 406 that is received by indentations in pawl teeth 401. The lock stop 404 catches on lock 344 when in position and allows the lock to push forward, breaking open the wrench. This may be seen in greater detail in FIGS. 12 and 13 when lock 344 is extended forward releasing the clamp housing halves. Lock pawl 400 ends up in proper position when pawl catch 406 is received by indentations in pawl teeth 401. As can be seen in FIG. 14, lock pawl 400 has a spring receiver 402 which also acts as the axis for pivoting to receive spring 403, which holds lock pawl in place.

Figure 14B:
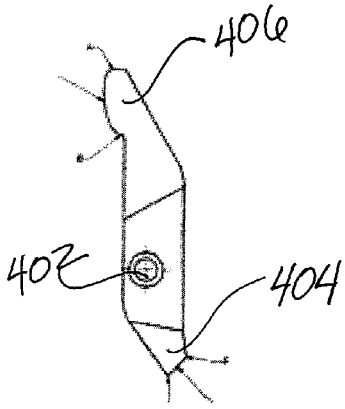
FIG. 14B is a side elevational view of the lock pawl.

FIG. 14B is a side elevational view of the lock pawl showing the side dimension of the lock pawl hook 404 and lock pawl catch 406.

Figure 14C:
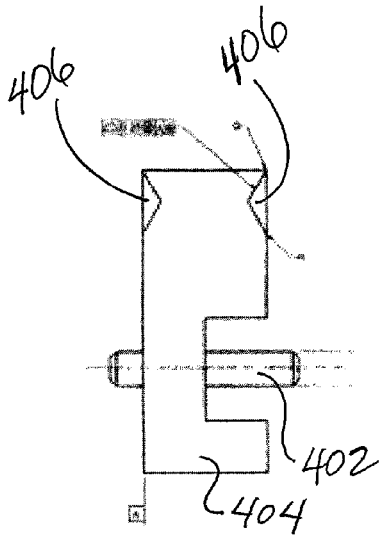
FIG. 14C is the rear elevational view of the lock pawl.

FIG. 14C shows a rear elevational view showing the spring receiver 402, lock pawl hook 404, and lock pawl catch 406.

Figure 14D:
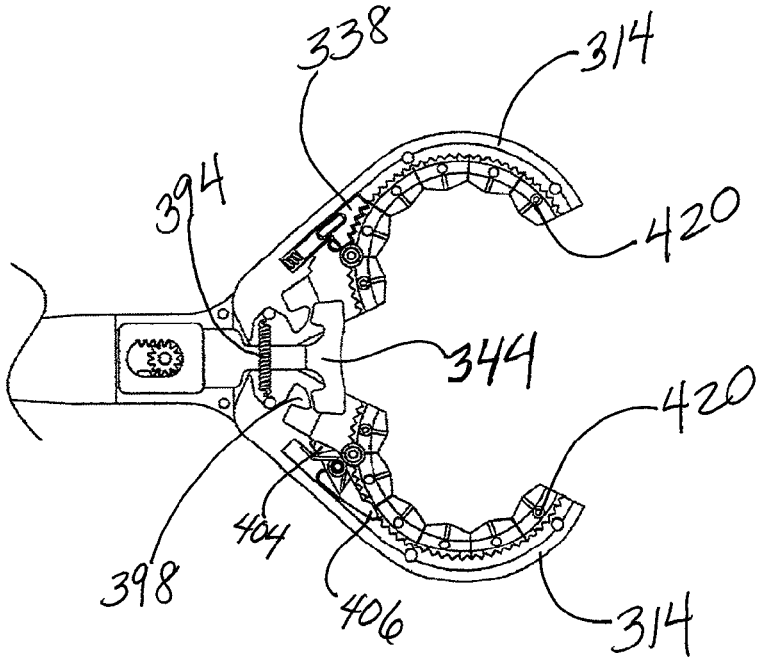
FIG. 14D is the top plan view of the lock pawl.

FIG. 14D shows the ratchet wrench in an open position, and clearly shows lock 344 in a fully forward position where the clamp key 398 is disengaged, and lock pawl 400 is properly positioned to properly allow lock key 344 to move forward disengaging with clamp key 398. Once clamp key 398 is disengaged and lock 344 is pushed forward, clamp housings 314 can swing out after the ratchet segments are locked in place by lock pins 420.

Figure 15:
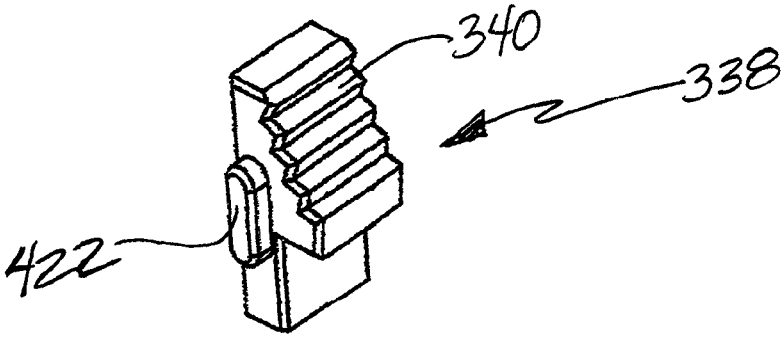
FIG. 15 is a front perspective view of a ratchet pawl.

FIG. 15 shows pawl 338 with pawl teeth 340 and ratchet pawl guide 322. Pawl teeth 340 engage the ratchet teeth 348 of FIG. 11, and effect the ratcheting device to make the wrench ratchet against the nut.

Figure 16:
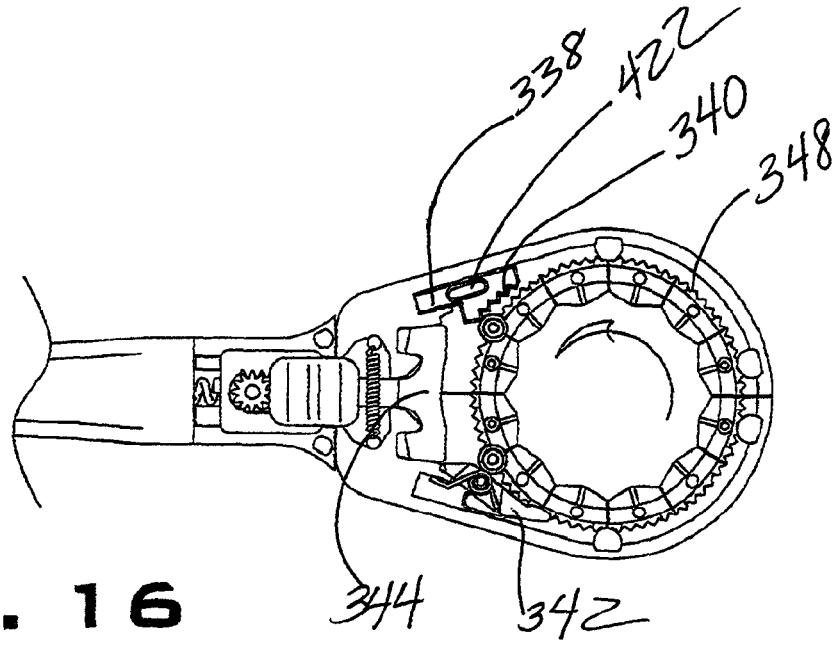
FIG. 16 is a top plan view of the wrench with the upper clamp housing removed to show the inner workings while the teeth are engage to illustrate how the lock pawl open to stop the lock.

FIG. 16 shows a situation where the ratchet teeth 348 and pawl teeth 340 are disengaged. Pawl 338 is not engaging with the ratchet teeth, nor is it preventing lock 344 from moving forward. Lock pawl 342 is in a position so that lock 344 can be pushed forward. Once lock 344 is pushed forward, the clamp housing can open and the wrench can open up. In order to reverse the ratcheting action, the operator merely needs to turn the clamping ratchet wrench over and use it in order to effect a reverse ratcheting motion.

Figure 17A:
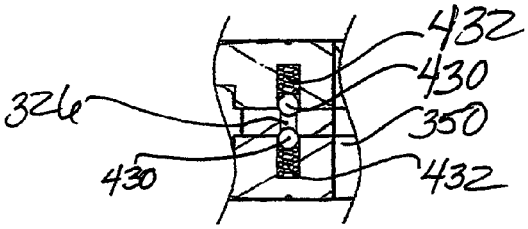
FIG. 17A is a cutaway side elevational view of lock balls in a lockdown position.
Figure 17B:
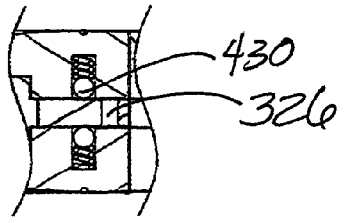
FIG. 17B is a cutaway side elevational view of lock balls in an open position.

With combined reference to FIGS. 17A and 17B, there are shown a pair of upper and lower lock balls 430 being urged into place by lock ball springs 432. Once alignment guide 326 comes into position where the lock balls 430 can be pushed into the indented portions of the face segment 350, lock balls 430 drop into place within the alignment guide 326 and prevent the ratchet segments 350 from coming out. FIG. 17B shows where the alignment indentation 326 is off center from the lock balls 430 and consequently the ratchet segment 350 is free to move.

Figure 17C:
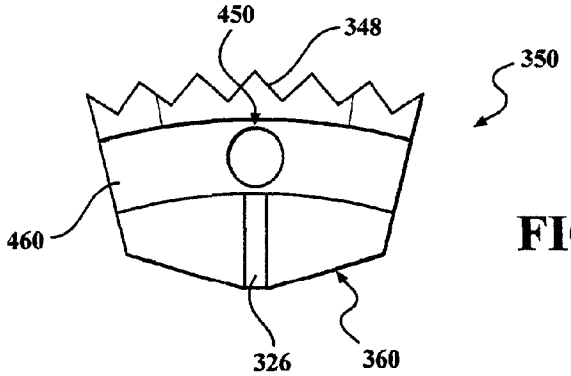
FIG. 17C is a top view of the ratchet segment illustrating the alignment guide.

FIG. 17C shows the top of ratchet segment 350 as shown in more detail with regard to FIGS. 11A and 11B, showing the ratchet teeth 348 with respect to alignment guide 326 and the ratchet segment face 360. Indentation 450 could not be seen previously in FIGS. 11A and 11B, but is an indentation that will receive lock balls 430. The channel portion 460 rides in a groove created by the clamp housing and the indentation 450 as it rolls around. The indentation receives the lock balls once the wrench is in alignment due to alignment guide 326. At that point, lock ball springs 432 will engage lock balls 430 into indentation 450, thereby locking the segments in place so that they won't come out of the wrench when the wrench is opened up. Regardless of any aspect of the invention, all the individual ratchet segments collectively form a wrench "race", like ball bearings in a roller skate wheel. The segments rotate freely within the "race", and ratchet and catch when the pawls connect.

Figure 18A:
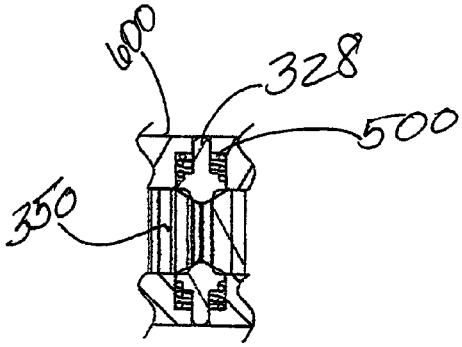
FIG. 18A is a side elevational cutaway view of lock pins in a closed position.
Figure 18B:
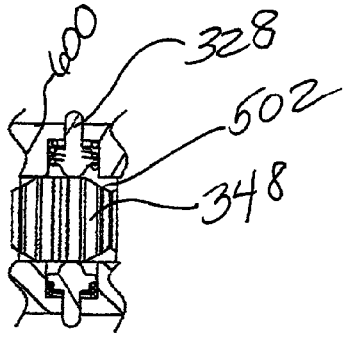
FIG. 18B is a side elevational cutaway view of lock pins in an open position.

With combined reference again to 18A and 18B, touch pins 328 are shown that were initially illustrated in FIG. 10 as element 328 for the user to feel when he is not able to view the ratchet wrench. When raised up, touch pins 328 indicate to the user that the wrench is in alignment and the wrench ratchet segments 350 are in a position so that he can open the wrench. Touch pins 328 are held in place by touch pin springs 500 which ride along the top of ratchet attachments 350. Looking back to FIG. 11A, one can see the ratchet teeth 348, where the design of the ratchet teeth has a downwardly facing ramp towards the outer edges of the teeth. Looking back to FIG. 18A, once can see that the ratchet segment 350 has an indentation which receives touch pin 328. FIG. 18B shows that when the ratchet segment is not properly aligned, touch pin 328 is extending upwardly and downwardly and the user can feel with his fingers to know that the ratchet segments are not aligned and it is not ready to be opened. Ratchet teeth 348 have a smaller dimension at either end, creating a smaller section 502. When smaller section 502 comes into proper alignment, the touch pin springs 500 push touch pins 328 upwardly and downwardly so that it feels smooth on the surface 600, and the operator will know the ratchet segments are in proper alignment so that he may open the ratchet wrench.

Figure 19:
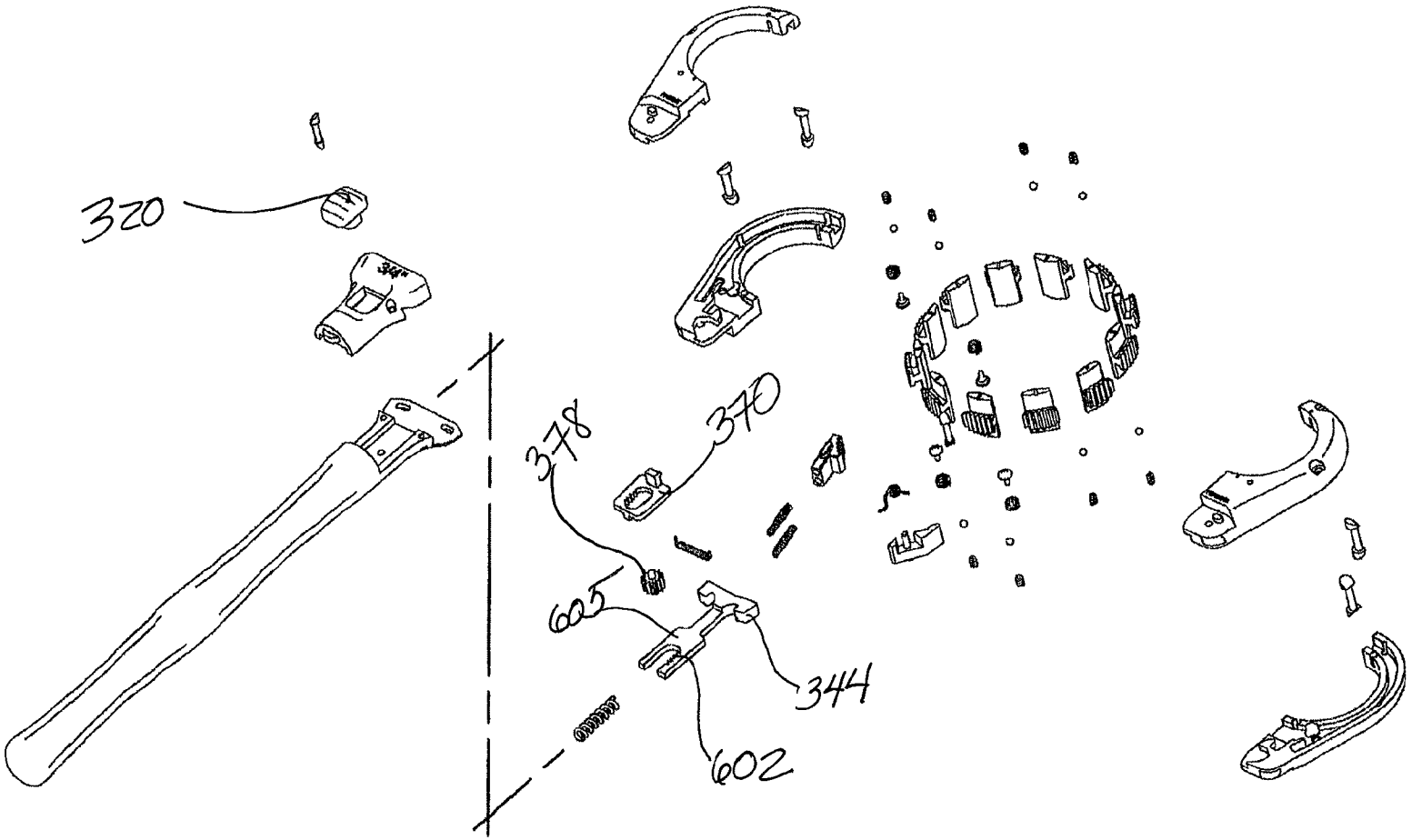
FIG. 19 is an exploded view of the component parts of the second aspect of the invention.

FIG. 19 is an exploded perspective view of all the parts of the working portions of the ratchet wrench made in accordance with the present invention. The one piece that has not been heretofore been shown or described in this disclosure is lock 344 having a distal extension 605 with lock gear teeth 602 on the interior portion that are engaged by lock gear 378, along with release slide 370. Lock gear 378 was previously shown in FIG. 11D with reference to its interaction with release slide 370 of FIG. 11C. However, lock gear 378 also engages the lock gear teeth 602 of lock 344. In operation, lock gear teeth 602 push lock 344 forward when the release slide 370 is urged backward when the retractable button 320 is operated.

The foregoing description of various aspects of the invention have been presented for purposes of illustration and description. They are not intended to be exhaustive or to limit the invention to the precise form disclosed. Obvious modifications or variations are possible in light of the above teachings with regards to the specific embodiments. The aspects were chosen and described in order to best illustrate the principles of the invention and their practical applications to thereby enable one of ordinary skill in the art to best utilize the invention in its various aspects and with various modifications as are suited to the particular use contemplated.

What is claimed is:

1. An open-ended clamping ratcheting wrench having an open position and a closed position for applying pressure around an article to be tightened, being a fastener such as a bolt or nut, when the wrench is in the closed position, comprising:

a clamp housing having at least one side portion capable of being opened and closed substantially within a plane to surround the article to be tightened, said clamp housing resulting in a closed end ratchet wrench when in the closed position, and wherein said clamp housing defines an interior race channel;

a plurality of individual ratchet segments having segment faces and integral gear teeth, all of said segments being contained and rotatable within the interior race channel inside the clamp housing when in the closed position, such that the plurality of segment faces collectively face toward the interior of the opening of the wrench, resulting in a socket shape configuration when the wrench is in the closed position, said socket-shape configuration being capable of gripping and ratcheting the fastener;

a handle having a longitudinal axis and being attached to and supporting the clamp housing, said handle embodying a retractable latch button for urging the at least one side portion of the clamp housing interchangeably between the open and closed positions; and at least one pawl for engaging with the gear teeth, such that the gear teeth of the ratchet segments mate against the surface of the pawl to enable ratcheting, wherein both of the side portions of the clamp housing pivot proximate the handle, and the open position of the clamp housing of the wrench is adapted for opening up along the longitudinal axis of the handle, such that the wrench can be used to approach a workpiece head on for ease of use.

2. The open-ended clamping ratcheting wrench of claim 1, wherein the clamp housing is formed around the segments, while forming the interior race channel.

3. The open-ended clamping ratcheting wrench of claim 1, wherein the clamp housing is made of a pair of upper and lower housing pieces secured together to form the clamp housing side portions of the wrench.

4. The open-ended clamping ratcheting wrench of claim 1, wherein the pivotable side portion of the clamp housing opens and separates from the other side portion of the clamp housing along a longitudinal axis of the handle to put the wrench in an open position.

5. The open-ended clamping ratcheting wrench of claim 1, further comprising a retractable latch button located within the handle, and wherein the retractable latch button pivots the clamp housing to urge the side portions together and automatically lock the segments into the closed position for ratcheting.

6. The open-ended clamping ratcheting wrench of claim 1, wherein the clamp housing side portions are hinged proximate the handle.

7. The open-ended clamping ratcheting wrench of claim 1, wherein the segments include interlocking ratchet keys to be held by the pawl, thereby enabling ratcheting of the wrench.

8. The open-ended clamping ratcheting wrench of claim 1, wherein the segments themselves are located within the interior race channel and form the resulting ratcheting socket.

9. The open-ended clamping ratcheting wrench of claim 1, wherein the wrench is adapted to be a line wrench.

10. The open-ended clamping ratcheting wrench of claim 1, wherein the wrench is adapted to ratchet a bolt.

11. The open-ended clamping ratcheting wrench of claim 1, wherein the wrench is adapted to ratchet a nut.

12. The open-ended clamping ratcheting wrench of claim 1, wherein said at least one pawl engages the gear teeth of the segments to allow rotation of the ratchet segments within the race channel of the clamp housing in one direction of rotation and to prevent rotation in the opposite direction.

13. The open-ended clamping ratcheting wrench of claim 1, wherein the at least one pawl is kept in place by a pawl spring.

14. The open-ended clamping ratcheting wrench of claim 1, wherein the at least one pawl is automatically engaged with the gear teeth of the ratchet segments, such that the gear teeth of the ratchet segments mate against the surface of the pawl to enable ratcheting.

* * * * *